US005761950A

United States Patent [19]

Chiu

[11] Patent Number: 5,761,950

[45] Date of Patent: Jun. 9, 1998

[54] TUBE BENDER

[76] Inventor: Ching-Su Chiu, No. 327, Peng Yi Rd., Tiping Hsian, Taichung Hsien, Taiwan

[21] Appl. No.: 813,442

[22] Filed: Mar. 10, 1997

[51] Int. Cl.[6] ..... B21D 9/05

[52] U.S. Cl. ..... 72/390.5; 72/389.1; 72/389.9

[58] Field of Search ..... 72/389.1, 389.2, 72/389.9, 390.5, 390.4

[56] References Cited

U.S. PATENT DOCUMENTS

| | | | |
|---|---|---|---|
| 3,824,835 | 7/1974 | Jackson | 72/389.9 |
| 5,237,847 | 8/1993 | Owens | 72/389.1 |
| 5,528,921 | 6/1996 | Herman | 72/389.1 |
| 5,615,572 | 4/1997 | Johnson et al. | 72/389.1 |

FOREIGN PATENT DOCUMENTS

| | | | |
|---|---|---|---|
| 164182 | 11/1900 | Germany | 72/390.5 |
| 168001 | 2/1906 | Germany | 72/390.5 |

*Primary Examiner*—David Jones
*Attorney, Agent, or Firm*—Staas & Halsey

[57] ABSTRACT

A tube bender includes a stepped handle having a second end portion with a level higher than that of a first end portion. A passage is defined in the second end portion of the handle for receiving a pushing rod. An L-shaped supporting base is fixedly mounted on the first end portion of the handle and has a vertical section on which a tube-bending block is mounted. An L-shaped driving ever has a vertical section pivotally mounted on an underside of the second end portion of the handle. A driven member is mounted between the vertical section of the driving lever and an underside of the pushing rod for moving the pushing rod, which in turn moves two auxiliary tube-bending blocks toward the tube-bending block.

7 Claims, 8 Drawing Sheets

TUBE BENDER

FIELD OF THE INVENTION

The present invention relates to a tube bender.

BACKGROUND OF THE INVENTION

A conventional tube bender is shown in FIG. 8 and there will be a complete illustration in the detailed description of the preferred embodiments.

The present invention has arisen to mitigate and/or obviate the disadvantage of the conventional tube bender.

SUMMARY OF THE INVENTION

In accordance with one aspect of the present invention, there is provided a tube bender comprising a stepped handle having a first end portion and a second end portion with a level greater than that of the first end portion, and a passage defined in the second end portion of the handle.

An L-shaped supporting base includes a horizontal section fixedly mounted on the first end portion of the handle. A tube-bending block is fixedly mounted on a vertical section o: the supporting base, and has an annular groove laterally defined therein.

A pushing rod has a first end portion movably mounted in the passage and a second end portion extending outward of the passage.

A linking base has a first end portion fixedly engaged with the second end portion of the pushing rod to move therewith. A supporting arm is disposed perpendicular to the pushing rod and is fixedly mounted on a second end portion of the linking base to move therewith.

Two auxiliary tube-bending blocks are each mounted on one end portion of the supporting arm and each have a cavity transversely defined therein and facing the annular groove of the tube-bending block.

An L-shaped driving lever has a vertical section pivotally mounted on an underside of the second end portion of the handle. A driven member is mounted between the vertical section of the driving lever and an underside of the pushing rod for moving the pushing rod, thereby moving each of the two auxiliary tube-bending blocks relative to the tube-bending block.

Further features of the present invention will become apparent from a careful reading of the detailed description with appropriate reference to the accompanying drawings.

DETAILED DESCRIPTION OF THE PREFERRED EMBODIMENTS

Figure 8:
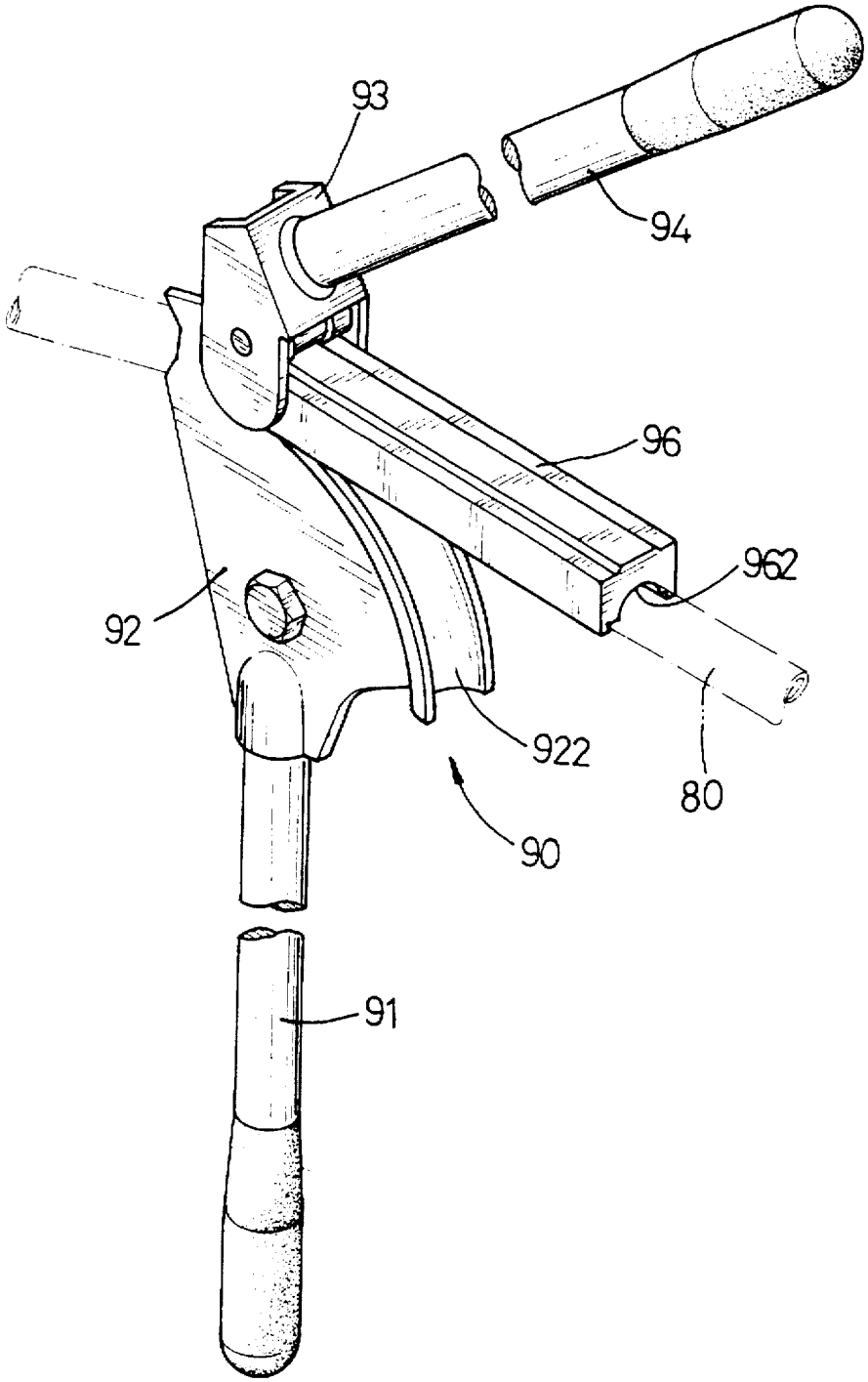
FIG. 8 PRIOR ART
FIG. 8 is a perspective view of a conventional tube bender in accordance with the prior art.

For a better understanding of features and benefits of the present invention, reference is now made to FIG. 8, illustrating a conventional tube bender 90 in accordance with the prior art.

The conventional tube bender 90 comprises a handle 91 fixed to a tube-bending base 92 which has an arcuate groove 922 defined therein, a pivot base 93 pivotally mounted on the tube-bending base 92, a driving lever 94 fixedly mounted on the pivot base 93, and an auxiliary tube-bending bar 96 fixedly mounted on the pivot base 93 and having an arc-shaped groove 962 defined therein.

In operation, a tube 80 is initially placed between the arc-shaped groove 962 of the auxiliary tube-bending bar 96 and the arcuate groove 922 of the tube-bending base 92. The driving lever 94 can be pivoted relative to the handle 91, thereby bending the tube 80 by means of the auxiliary tube-bending bar 96.

By such an arrangement, however, the bending angle of the tube 80 is a constant and cannot be adjusted, thereby greatly limiting the utility of the tube bender.

Referring now to FIGS. 1–4, a tube bender in accordance with a first embodiment of the present invention can be provided for bending a tube 60 such as a metallic tube and the like.

The tube bender comprises a stepped handle 10 having a firs end portion 11 and a second end portion 12 with a level higher than that of the first end portion 11, and a passage 120 longitudinally defined in the second end portion 12 of the handle 10.

A substantially L-shaped supporting base 40 includes a horizontal section 41 fixedly mounted on the first end portion 11 of the handle 10. A positioning bolt 116 extends through a bore 112 defined in the first end portion 11 of the handle 10 and through a threaded bore 410 defined in the horizontal section 41 of the supporting base 40, thereby fixing the supporting base 40 on the handle 10.

A semi-cylindrical tube-bending block 50 is mounted on a vertical section 43 of the supporting base 40, and has an annular groove 52 laterally defined therein. A recess 54 is defined in the tube-bending block 50 for receiving a stub 44 of the vertical section 43 of the supporting base 40.

A pushing rod 14 has a first end portion 140 movably mounted in the passage 120 and a second end portion 144 extending outward of the passage 120. A plurality of teeth 142 are formed on an underside of the pushing rod 14.

A linking base 20 has a vertical section 21 engaged with the second end portion 144 of the pushing rod 14 to move therewith. An opening 210 is defined in the vertical section 21 of the linking base 20 for securely receiving the first end portion 144 of the pushing rod 14.

A supporting arm 30 is disposed perpendicular to the pushing rod 14 and is mounted to a horizontal section 23 of the linking base 20 to move therewith. A positioning bolt 25 extends through a bore 24 defined in the horizontal section 23 of the linking base 20 and through a threaded bore 31 defined in a mediate portion of the supporting arm 30, thereby fixing the supporting arm 30 on the linking base 20.

The supporting arm 30 includes two end portions each having a plurality of adjusting holes 32 defined therein.

Two auxiliary tube-bending blocks 33 are each mounted on an underside of a respective one end portion of the supporting arm 30 and each have two sides each defining a cavity 332.

Two positioning bolts 34 each extend through an axial hole 334 defined in each of the two auxiliary tube-bending blocks 33, and through a respective one of the adjusting holes 32, and are each engaged with a nut 342, thereby attaching each of the two auxiliary tube-bending blocks 33 to the supporting arm 30.

A substantially L-shaped driving lever 15 includes a vertical section 150 pivotally mounted in an opening 13 (see FIG. 3) which is defined in an underside of the second end portion 12 of the handle 10.

A driven pin 16 is mounted between the vertical section 150 of the driving lever 15 and the underside of the pushing rod 14 for moving the pushing rod 14, thereby moving each of the two auxiliary tube-bending blocks 33 relative to the tube-bending block 50.

A chamber 151 is defined in the vertical section 150 of the driving lever 15 For receiving the driven pin 16 which has a chamfered upper end 164 detachably meshing with the teeth 142 of the pushing rod 14.

A pivot pin 153 extends through a first pivot bore 104 defined in the second end portion 12 of the handle 10, a second pivot bore 152 defined in the vertical section 150 of the driving lever 15, and an elongate third pivot bore 162 defined in the driven pin 16 such that the vertical section 150 of the driving lever 15 together with the driven pin 16 can be pivoted relative to the handle 10.

A spring 168 is mounted in a space 166 which is defined in an underside of the driven pin 16.

An ear 154 is formed on an underside of the vertical section 150 of the driving lever 15, and a returning spring 156 has a first end attached to the underside of the first end portion 11 of the handle 10 and a second end attached to the ear 154.

A block 17 is formed on the underside of the second end portion 12 of the handle 10. A socket 172 is defined in the block 17 and communicates with the passage 120 of the handle 10.

A snapping member 18 is movably mounted in the socket 172 and has a chamfered upper end 182 detachably meshing with the teeth 142 of the pushing rod 14. An extension 188 extends from the snapping member 18 and movably extends through a slot 174 laterally defined in the block 17.

A spring 186 is mounted in a compartment 184 defined in the snapping member 18 and is retained between the snapping member 18 and a cover 19 which is fixedly mounted on an underside of the block 17.

A hook 155 is formed on the vertical section 150 of the driving lever 15 and is engagable with the extension 188 for urging the snapping member 18 downwardly.

Figure 1:
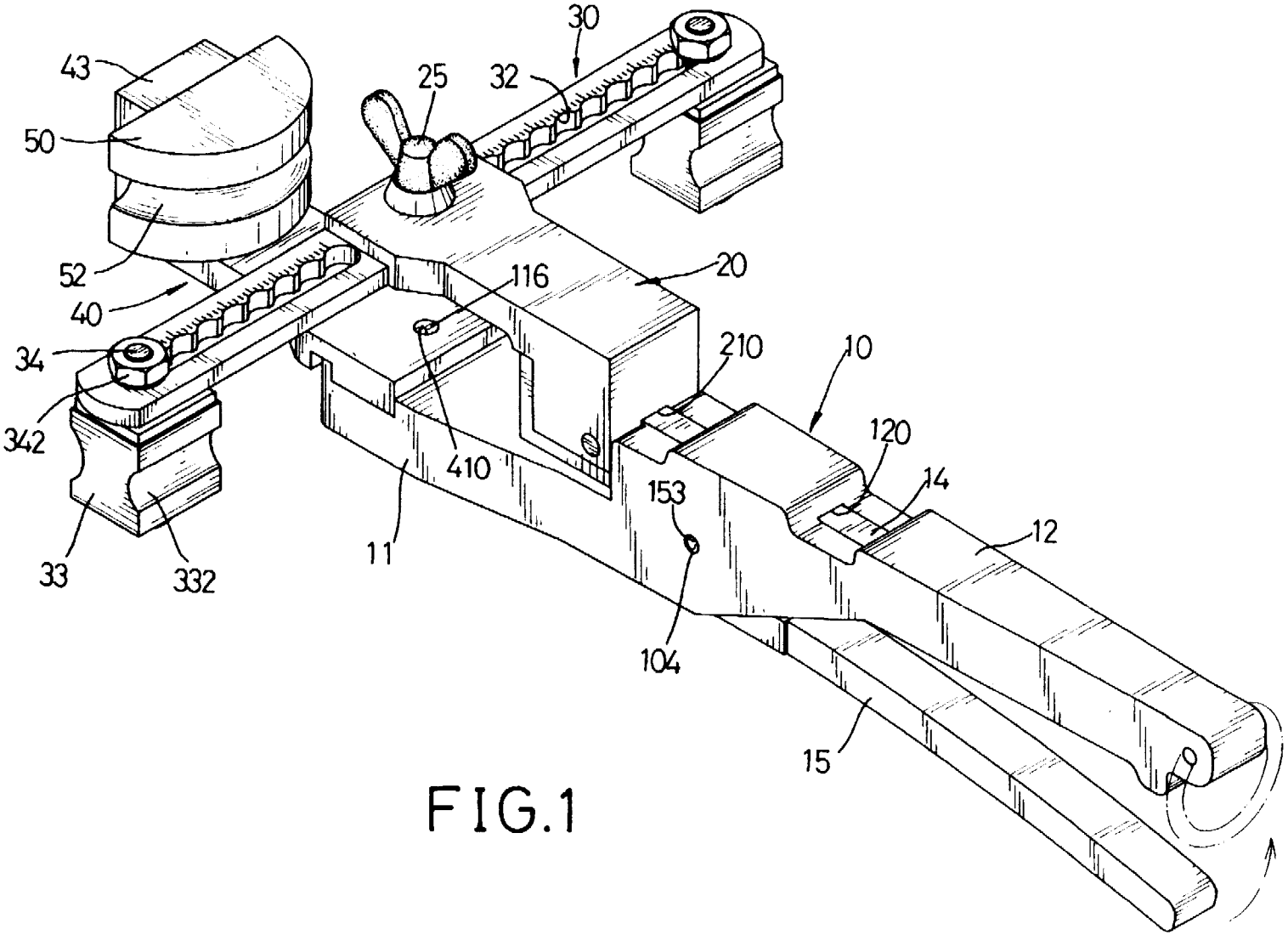
FIG. 1 is a perspective view of a tube bender according to a first embodiment of the present invention.
Figure 2:
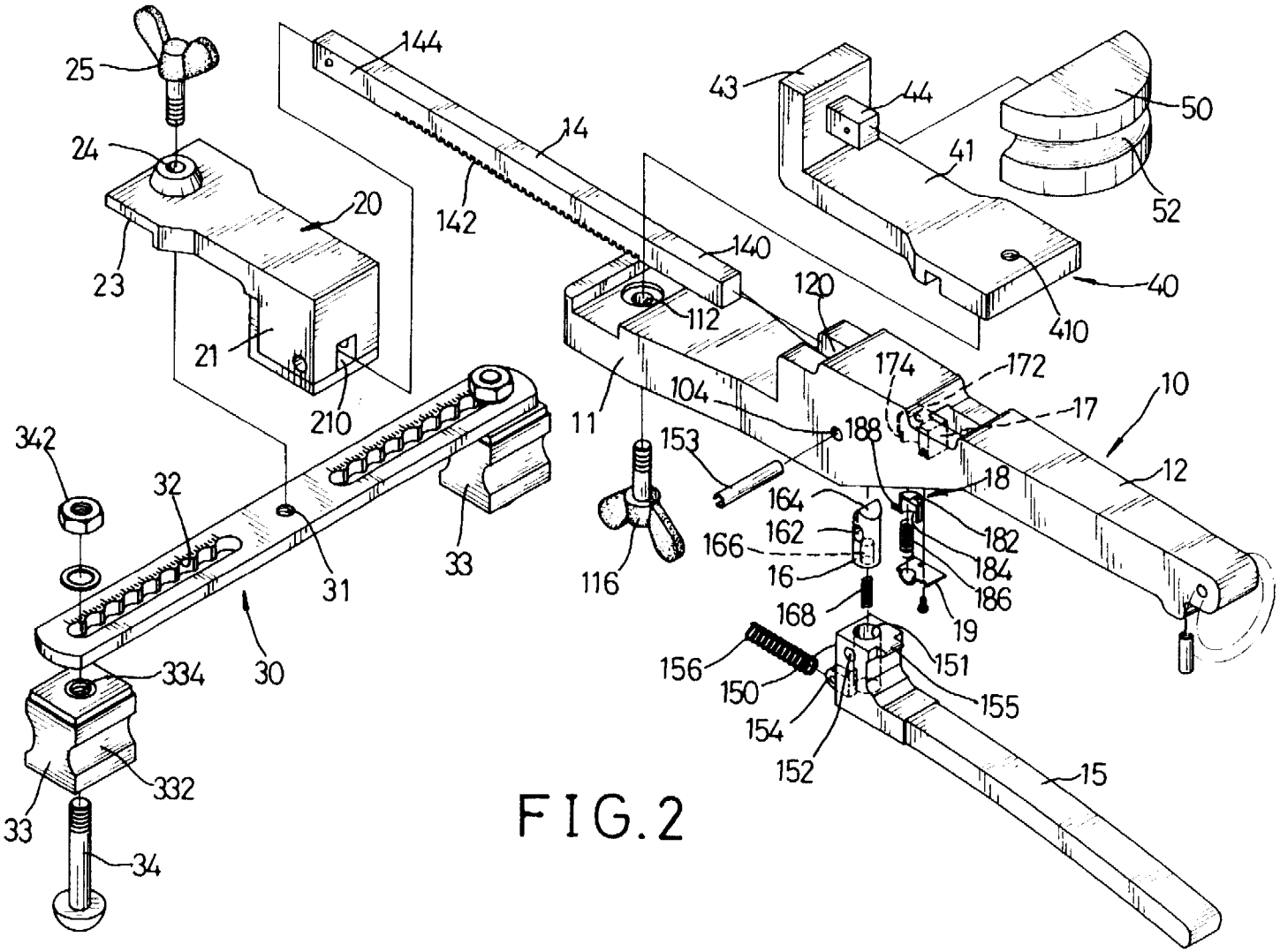
FIG. 2 is an exploded view of FIG. 1.
Figure 3:
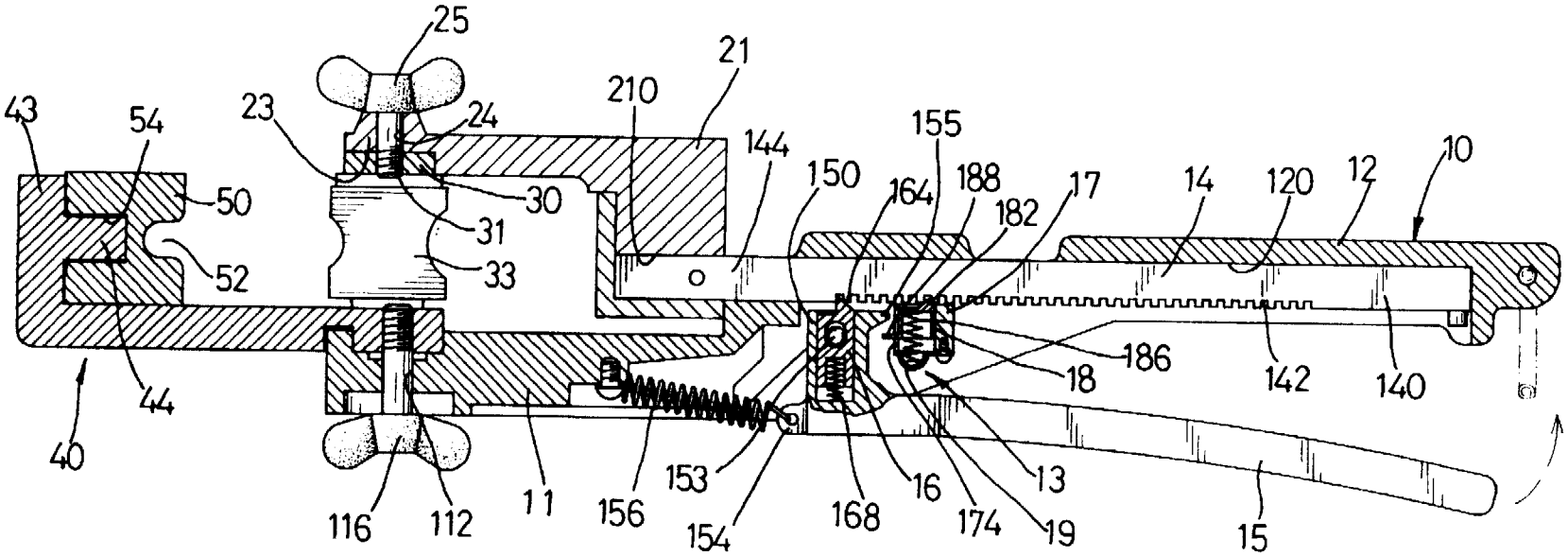
FIG. 3 is a front plan cross-sectional view of FIG. 1.
Figure 4:
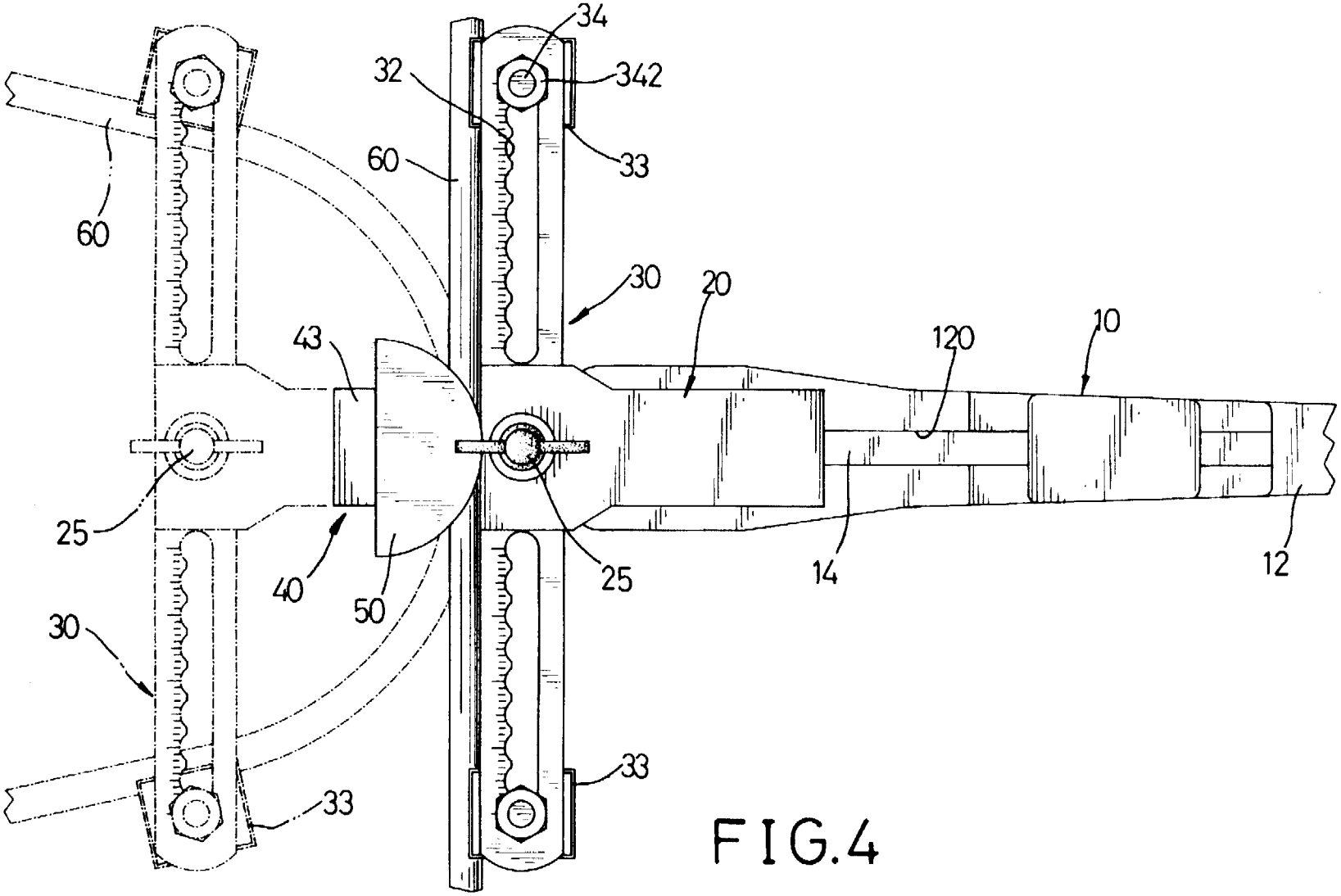
FIG. 4 is a top plan operational view of FIG. 1.

In operation, referring to FIGS. 3 and 4 with reference to FIGS. 1 and 2, the tube 60 to be bent is placed between the tube-bending block 50 and the two auxiliary tube-bending blocks 33, with a mediate portion of the tube 60 received in the annular groove 52 and with two distal ends of the tube 60 each received in a respective one of the cavities 332.

The driving lever 15 can be pivoted relative to the handle 10 about the pivot pin 153 by exerting a force on the driving lever 15 such that the tapered upper end 164 of he driven pin 16 can be urged on the teeth 142 to move the pushing rod 14 which in turn moves the linking base 20 and the supporting arm 30, thereby moving each of the two auxiliary tube-bending blocks 33 toward the tube-bending block 50.

The driving lever 15 can then be pivoted outwardly relative to the handle 10 due to the action o the returning spring 156 when the force is removed, thereby detaching the tapered upper end 164 of the driven pin 16 from the teeth 142.

In such a situation, the tapered upper end 182 of the snapping member 18 can be used to stop the teeth 142, thereby preventing the pushing rod 14 from moving backward.

The driving lever 15 can then be pivoted relative to the handle 10 when the force is exerted on the driving lever 15 such that the tapered upper end 164 of the driven pin 16 can be urged on the teeth 142 to move the pushing rod 14 repeatedly, thereby moving the two auxiliary tube-bending blocks 33 toward the tube-bending block 50 continually to a position as shown in phantom lines in FIG. 4, and thereby bending the tube 60.

By such an arrangement, the bending angle of the tube 60 can be adjusted arbitrarily, thereby greatly increasing the versatility of the tube bender.

Figure 5:
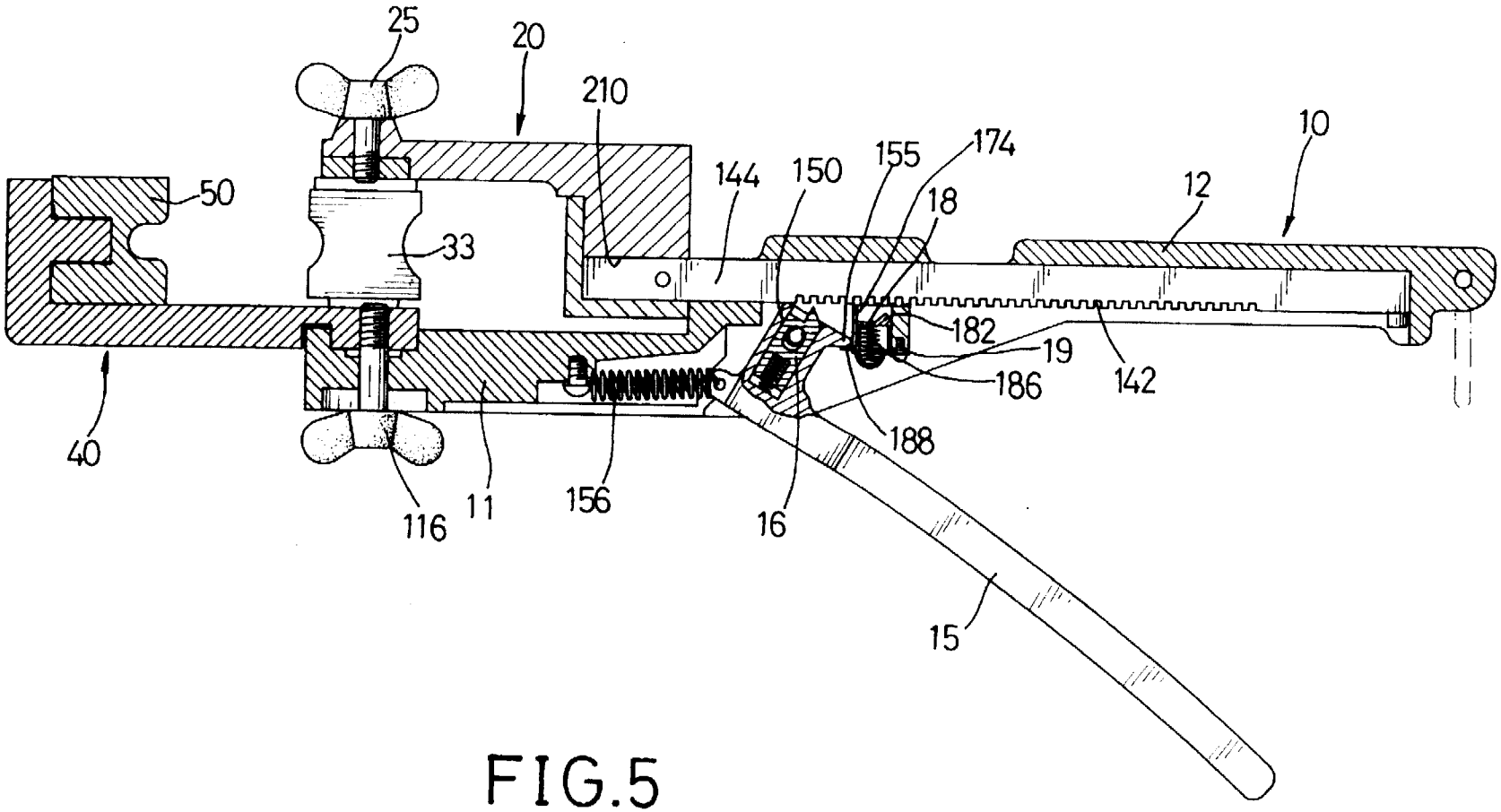
FIG. 5 is an operational view o FIG. 3.

Referring to FIG. 5, when the tube 60 has been bear as required, the driving lever 15 can be further pivoted outwardly relative to the handle 10 such that the hook 155 can be urged on the extension 188 so as to urge the snapping member 18 downwardly, thereby detaching the chamfered upper end 182 of the snapping member 18 from the teeth 142 such that the pushing rod 14 can be moved backward, thereby moving the two auxiliary tube-bending blocks 33 outwardly relative to the tube-bending block 50.

Figure 6:
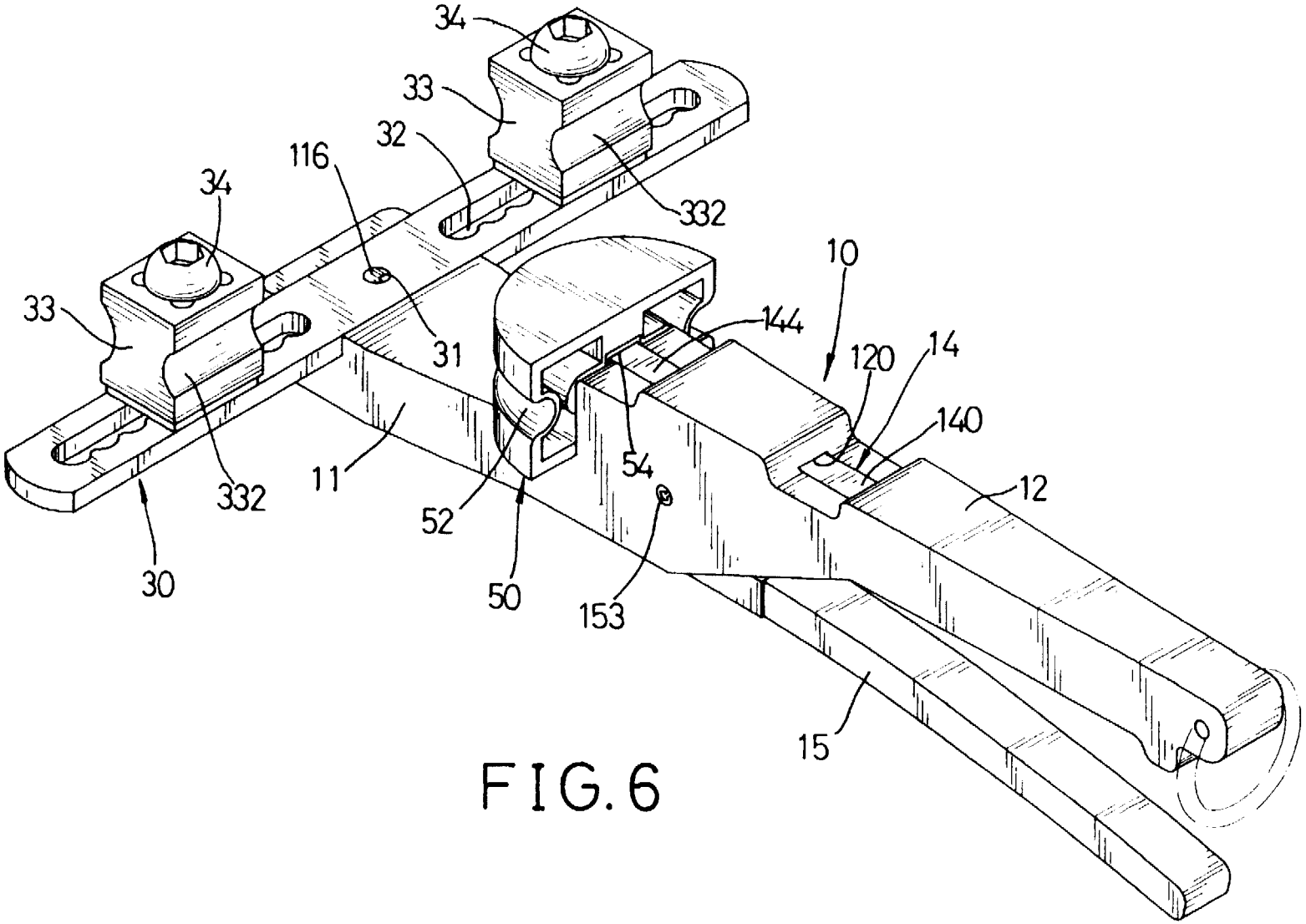
FIG. 6 is a perspective view of a tube bender according to a second embodiment of the present invention.
Figure 7:
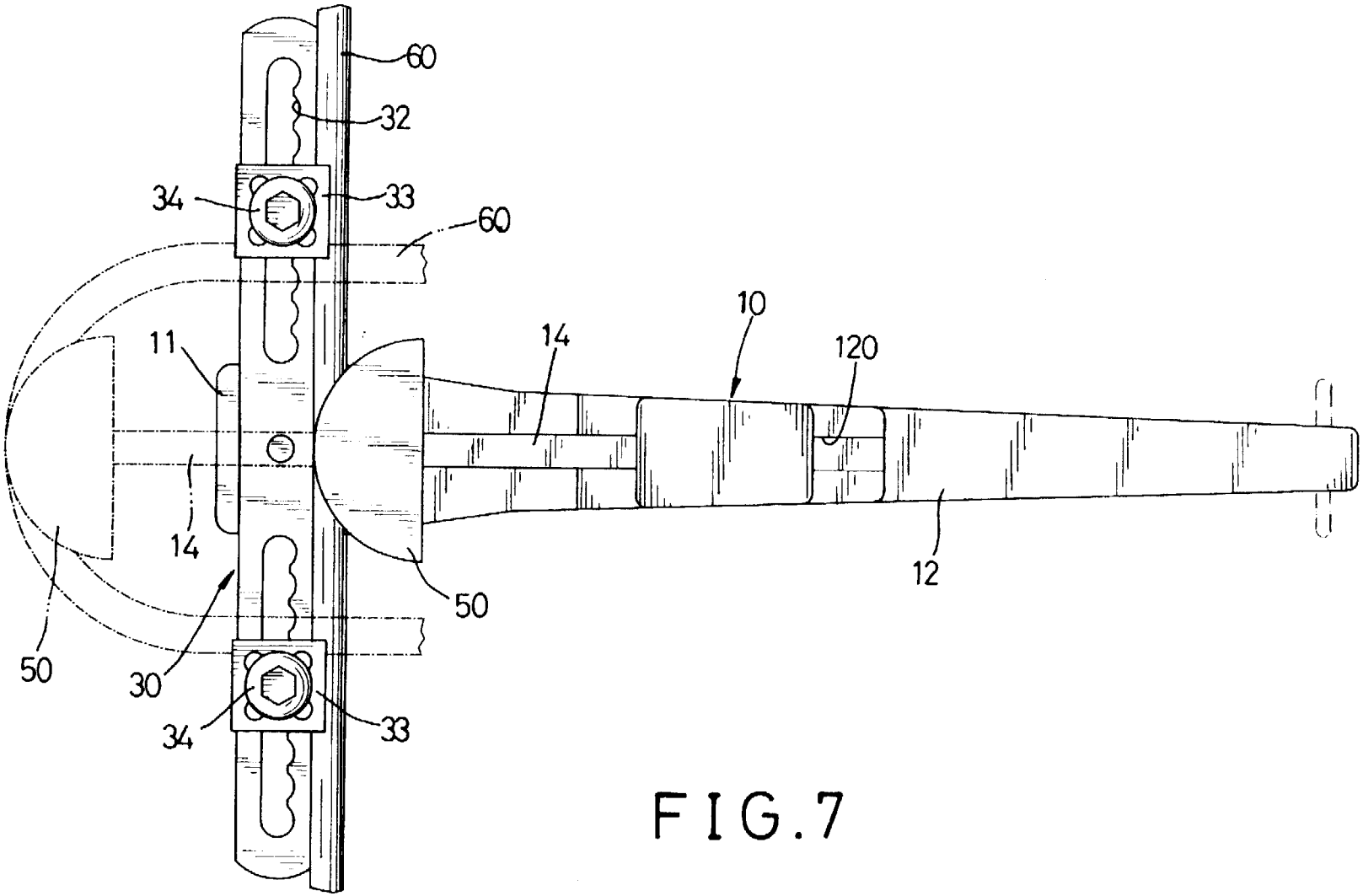
FIG. 7 is a top plan operational view of FIG. 6.

Referring to FIGS. 6 and 7, in accordance with a second embodiment of the present invention, the tube-bending block 50 is fitted on the pushing rod 14 to move therewith, with the second end portion 144 of the pushing -rod 14 received in the recess 54 of the tube-bending block 50.

The supporting arm 30 is fixedly mounted on the first end portion 11 of the handle 10 directly, and each of the two auxiliary tube-bending blocks 33 is adjustably mounted on an upperside of a respective one of the end portions of the supporting arm 30.

The operation of the second embodiment is similar to that of the first embodiment, and will not be described in detailed.

It should be clear to those skilled in the art that further embodiments of the present invention may be made without departing from the spirit and scope of the present invention.

What is claimed is:

1. A tube bender comprising:

a stepped handle having a first end portion and a second end portion each having a first side and a second side, and a passage defined in the second end portion;

a substantially L-shaped supporting base including a first section parallel with and fixedly mounted on said first side of said first end portion of said stepped handle and a second section perpendicular to said first section;

a tube-bending block fixedly mounted on said second section of said supporting base, and having an annular groove;

a pushing rod having a first side, a second side, a first end portion movably mounted in said passage, and a second end portion extending outward of said passage;

a linking base having a first end portion fixedly engaged with the second end portion of said pushing rod to move therewith;

a supporting arm perpendicular to said pushing rod and fixedly mounted on said second end portion of said linking base to move therewith;

two auxiliary tube-bending blocks each mounted on respective end portions of said supporting arm and each having a cavity transversely defined therein and facing said annular groove of said tube-bending block;

a substantially L-shaped driving lever having a lever arm and an upright section perpendicular thereto and pivotally mounted on said second side of the second end portion of said handle; and a driven member mounted between said upright section of said driving lever and said second side of said pushing rod, for moving said pushing rod, thereby moving each of said two auxiliary tube-bending blocks relative to said tube-bending block.

2. The tube bender according to claim 1, wherein said pushing rod has a plurality of teeth formed on the second side thereof, a chamber defined in the upright section of said driving lever, said driven member being received in said chamber and having a chamfered end meshing with said teeth.

3. The tube bender according to claim 2, wherein a first pivot bore is defined in the second end portion of said handle, a second pivot bore is defined in the upright section of said driving lever, a third pivot bore is defined in said driven member, and a pin extends through said first pivot bore, said second pivot bore, and said third pivot bore.

4. The tube bender according to claim 3, wherein said upright section of said driving lever includes a first end adjacent to said second side of said pushing rod and a second end, an ear is formed on said second end of said upright section of said driving lever, and a biasing member having a first end attached to said first end portion of said handle and a second end attached to said ear.

5. The tube bender according to claim 2, further comprising a block including a first side formed on said second side of said second end portion of said handle and a second side, a socket defined in said block and communicating with said passage, a slot laterally defined in said block and communicating with said socket, a cover mounted on said second side of said block, a snapping member movably mounted in said socket and having a chamfered end meshing with said teeth, an extension extending from said snapping member and movably extending through said slot, a compartment defined in said snapping member, a biasing member mounted in said compartment and urged between said snapping member and said cover, and a hook formed on said upright section of said driving lever and engagable with said extension.

6. The tube bender according to claim 1, wherein said supporting arm includes a first side fixedly mounted on said second end portion of said liking base, a second side, and two end portions each defining a plurality of adjusting holes, each of said two auxiliary tube-bending blocks mounted on said second side of said supporting arm and defining an axial hole, two positioning bolts each extending through said axial hole of a respective one of said two auxiliary tube-bending blocks and a respective adjusting hole of a respective one of said two end portions of said supporting arm, and two nuts respectively engaged with said two positioning bolts.

7. A tube bender comprising:

a stepped handle having a first end portion and a second end portion each having a first side and a second side, and a passage defined in the second end portion of said handle;

a pushing rod having a first side, a second side, a first end portion movably mounted in said passage and a second end portion extending outward of said passage;

a tube-bending block fixedly mounted on the second end portion of said pushing rod to move therewith and defining an annular groove;

a supporting arm disposed perpendicular to said pushing rod and fixedly mounted on the first end portion of said handle;

two auxiliary tube-bending blocks each mounted on respective end portions of said supporting arm and each having a cavity transversely defined therein and facing said angular groove of said tube-bending block;

a substantially L-shaped driving lever having a lever arm and an upright section perpendicular thereto and pivotally mounted on said second side of the second end portion of said handle; and a driven member mounted between said upright section of said driving lever and said second side of said pushing rod, for moving said pushing rod, thereby moving said tube-bending block relative to each of said two auxiliary tube-bending blocks.

* * * * *